US010651581B1

(12) United States Patent
Sasayama et al.

(10) Patent No.: US 10,651,581 B1
(45) Date of Patent: May 12, 2020

(54) CONNECTOR

(71) Applicant: Molex, LLC, Lisle, IL (US)

(72) Inventors: Naoto Sasayama, Yamato (JP); Shiro Tsukashima, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/505,714

(22) Filed: Jul. 9, 2019

(30) Foreign Application Priority Data

Oct. 18, 2018 (JP) ..... 2018-196270

(51) Int. Cl.

| | |
|---|---|
| ***H01R 12/71*** | (2011.01) |
| ***H01R 12/57*** | (2011.01) |
| ***H01R 12/52*** | (2011.01) |
| ***H01R 13/62*** | (2006.01) |
| ***H01R 12/70*** | (2011.01) |
| ***H01R 4/02*** | (2006.01) |

(52) U.S. Cl.
CPC ..... *H01R 12/716* (2013.01); *H01R 4/02* (2013.01); *H01R 12/52* (2013.01); *H01R 12/57* (2013.01); *H01R 12/7005* (2013.01); *H01R 12/7082* (2013.01); *H01R 13/62* (2013.01)

(58) Field of Classification Search
CPC ..... H01R 12/71; H01R 23/68; H01R 13/11; H01R 12/716
See application file for complete search history.

(56) References Cited

U.S. PATENT DOCUMENTS 5,545,051 A * 8/1996 Summers ..... H01R 12/716 439/350
5,626,482 A * 5/1997 Chan ..... H01R 12/716 439/74
6,116,949 A * 9/2000 Costello ..... H01R 13/6485 439/509
6,855,004 B2 * 2/2005 Soh ..... H01L 23/60 439/41
6,955,546 B1 * 10/2005 Huang ..... H01R 13/5213 439/135

(Continued)

FOREIGN PATENT DOCUMENTS

JP 2015-207557 A 11/2015
JP 2016-195057 A 11/2016
JP 2016195057 A * 11/2016 ..... H01R 12/7052

*Primary Examiner* — Abdullah A Riyami
*Assistant Examiner* — Nader J Alhawamdeh
(74) *Attorney, Agent, or Firm* — Molex, LLC

(57) ABSTRACT

A connector body includes a recess, a middle island inside the recess, and a mating guide part formed on both sides in the longitudinal direction; a reinforcing metal bracket includes a main body part disposed on the end wall part of the mating guide part, and a central guide part which is connected to the main body part and has a tip which engages with the island end part of the middle island; and the central guide part includes an end wall inner cover part connected to the main body part, an island end cover part which is connected to the tip and covers at a portion of the island end, and a bottom part which is connected to a lower end of the end wall inner cover part via a first curved part and is connected to a lower end of the island end cover part via a second curved part; wherein a lower surface of the first curved part is positioned above a lower surface of the second curved part.

15 Claims, 11 Drawing Sheets

(56) References Cited

U.S. PATENT DOCUMENTS 7,074,085 B2 * 7/2006 Chen ..... H01R 13/658 439/607.36
7,232,317 B2 * 6/2007 Ookura ..... H01R 13/506 439/660
7,367,816 B2 * 5/2008 Liu ..... H01R 13/26 439/74
7,748,994 B1 * 7/2010 Peng ..... H01R 12/716 439/660
7,922,499 B2 * 4/2011 Liao ..... H01R 12/714 439/660
8,272,881 B2 * 9/2012 Miyazaki ..... H01R 12/716 439/345
8,292,635 B2 * 10/2012 Little ..... H01R 12/7029 439/570
8,992,233 B2 * 3/2015 Miyazaki ..... H01R 12/707 439/74
2004/0018756 A1 * 1/2004 Pan ..... H01R 13/6271 439/74
2010/0130068 A1 * 5/2010 Peng ..... H01R 13/2457 439/660
2010/0190383 A1 * 7/2010 Yamada ..... H01R 13/6315 439/680
2011/0165797 A1 * 7/2011 Takeuchi ..... H01R 12/716 439/660
2011/0250800 A1 * 10/2011 Guo ..... H01R 12/716 439/660
2013/0012074 A1 * 1/2013 Mashiyama ..... H01R 12/73 439/660
2013/0023162 A1 * 1/2013 Harlan ..... H01R 12/73 439/660
2013/0280926 A1 * 10/2013 Ono ..... H01R 12/712 439/65
2014/0227910 A1 * 8/2014 Tanaka ..... H01R 12/7052 439/626
2015/0207248 A1 * 7/2015 Takenaga ..... H01R 12/716 439/74

* cited by examiner

CONNECTOR

RELATED APPLICATIONS

This application claims priority to Japanese Application No, 2018-196270, filed on Oct. 18, 2018, which application is incorporated herein by reference in its entirety.

TECHNICAL FIELD

The present disclosure relates to a connector.

BACKGROUND ART

Conventionally, connectors such as board to board connectors, etc., have been used to electrically connect pairs of parallel circuit boards together. Such connectors are attached to each mutually facing surface on pairs of circuit boards and mated together so as to be connected. In addition, technology has been proposed in which reinforcing brackets attached to both ends function as locking members to maintain a mated state with the counterpart connector (for example, see Patent Document 1).

FIGS. 11A and 11B are cross-sectional views illustrating a conventional connector. Note that in the drawing, FIG. 11A is a diagram illustrating a state before mating, and FIG. 11B is a diagram illustrating a state after mating.

In the drawing, 811 is a first housing serving as a housing of a first connector mounted to a first circuit board (not illustrated), and 911 is a second housing serving as a housing of a second connector mounted to a second circuit board (not illustrated). The first connector and the second connector are mated so that the first circuit board and the second circuit board are electrically connected. Note that in FIG. 11A, the mating face of the first housing 811 faces upward, while the mating face of the second housing 911 faces downward, and in this orientation, the second connector is moved relative to the first connector in the direction indicated by the arrow and mated as illustrated in FIG. 11B.

The first housing 811 includes a recess 812 into which the second housing 911 is inserted, a projection 813 formed in the center of the recess 812, and end wall parts 821 on both ends in the longitudinal direction. A plurality of first terminals 861 are attached to the first housing 811, and a first reinforcing bracket 851 is attached to both ends in the longitudinal direction. The first reinforcing bracket 851 includes an end wall covering part 857 which covers at least a portion of the end wall part 821, a projection covering part 859 which covers at least a portion of the end in the longitudinal direction of the projection 813, and a recess covering part 858 which connects the end wall covering part 857 and the projection covering part 859 and covers at least a portion of the recess 812.

Meanwhile, the second housing 911 includes a projection side part 922 extending in the longitudinal direction and projection end parts 921 at both ends in the longitudinal direction. Further, a plurality of second terminals 961 are attached to the projection side part 922, and a second reinforcing bracket 951 is attached to the projection end parts 921.

As illustrated in FIG. 11B, when the first connector and the second connector are mated, the corresponding first terminal 861 and second terminal 961 come into contact with one another. As a result, the first circuit board and the second circuit board are electrically connected. In addition, the second housing 911 is inserted into the recess 812 of the first housing 811 so that the second reinforcing bracket 951 engages with the first reinforcing bracket 851. Note that when the second housing 911 is inserted into the recess 812 of the first housing 811, the second reinforcing bracket may impinge on the end in the longitudinal direction of the projection 813, but the projection cover part 859 of the first reinforcing bracket 851 covers at least a portion of both ends in the longitudinal direction of the projection 813, so the end in the longitudinal direction of the projection 813 is protected.

Patent Document: Patent Document 1: JP 2016-195057 A

SUMMARY

However, in the conventional connector described above, when the second housing 911 is inserted into the recess 812 of the first housing 811, even if the second reinforcing bracket 951 impinges on the end wall covering part 857 of the first reinforcing bracket 851, a force is applied to the end in the longitudinal direction of the projection 813, so the end in the longitudinal direction of the projection 813 may be damaged.

Here, an object is to solve the problems of the conventional connector described above and to provide a highly reliable connector in which the protected state of the housing is maintained with certainty during the mating operation.

Therefore, a connector includes a connector body, a terminal mounted on the connector body, and a reinforcing bracket mounted on the connector body; wherein: the connector body includes a recess which mates with a counterpart connector body of a counterpart connector, a middle island inside the recess which mates with a recessed groove of the counterpart connector body, and a mating guide part which is formed on both ends in a longitudinal direction, on which a mating recess is formed into which a counterpart mating guide part formed on both ends in a longitudinal direction of the counterpart connector body is inserted; the reinforcing bracket includes a main body part disposed on an end wall of the mating guide part, and a central guide part which is connected to the main body part, which has a tip which engages with an island end of the middle island, and which extends in a longitudinal direction of the connector body along an inside of the mating recess; the central guide part includes an end wall inner cover part connected to the main body part, an island end cover part which is connected to the tip and covers at least a portion of the island end, and a bottom part which is connected to a lower end of the end wall inner cover part via a first curved part and is connected to a lower end of the island end cover part via a second curved part; wherein a lower surface of the first curved part is positioned above a lower surface of the second curved part.

In another connector, a bottom plate which defines a bottom face of the mating recess has a bottom opening formed so as to penetrate the bottom plate in a plate thickness direction; the bottom part is housed inside the bottom opening; and the second curved part is exposed to a lower surface of the connector body.

In yet another connector, the bottom part is wider than other portions of the central guide part.

In yet another connector, the end wall inner cover part includes an inclined part having a base end connected to the main body part and extending diagonally downward.

In yet another connector, when a counterpart reinforcing bracket attached to a counterpart mating guide part of the counterpart connector body comes into contact with the inclined part, the counterpart reinforcing bracket slides along the inclined part, and the counterpart mating guide part is guided into the mating recess.

In yet another connector, the reinforcing bracket further includes a connecting arm part which is connected to both left and right ends of the main body part and extends in a longitudinal direction of the connector body, and a contact arm part which is connected to the connecting arm part and extends downward within the mating recess; and the contact arm part includes a contact part which makes contact with a counterpart reinforcing bracket attached to a counterpart mating guide part inserted into the mating recess.

In yet another connector, island end side surfaces on both sides of the island end are inclined surfaces so that a dimension in the width direction of the island end gradually decreases toward the end wall part in a plan view.

A connector assembly includes the connector and a counterpart connector which mate with the connector.

According to the present disclosure, the connector can enhance reliability by ensuring that the protected state of the housing is maintained with certainty during the mating operation.

BRIEF DESCRIPTION OF DRAWINGS

FIGS. 5A-5C are horizontal cross-sectional views of the first connector according to the present embodiment, wherein FIG. 5A is a cross-sectional view along arrows B-B in FIG. 3, FIG. 5B is a cross-sectional view along arrows C-C in FIG. 3, and FIG. 5C is a cross-sectional view along arrows D-D in FIG. 3.

FIGS. 9A and 9B are enlarged views of relevant parts of the side cross-section of the first connector and the second connector according to the present embodiment, wherein FIG. 9A is an enlarged view of the portion near the left end in FIG. 4, and FIG. 9B is a view of the portion corresponding to FIG. 9A when the first connector and the second connector are mated in a displaced state in the X-axis direction.

FIGS. 10A and 10B are perspective views illustrating a state in which the first connector and the second connector according to the present embodiment are mated, wherein FIG. 10A is a view from the second connector side, and FIG. 10B is a view from the first connector side.

FIGS. 11A and 11B are cross-sectional views illustrating a conventional connector, wherein FIG. 11A is a view illustrating a state before mating, and FIG. 11B is a view illustrating a state after mating.

DETAILED DESCRIPTION OF THE PREFERRED EMBODIMENTS

An embodiment will be described in detail below with reference to drawings.

Figure 1:
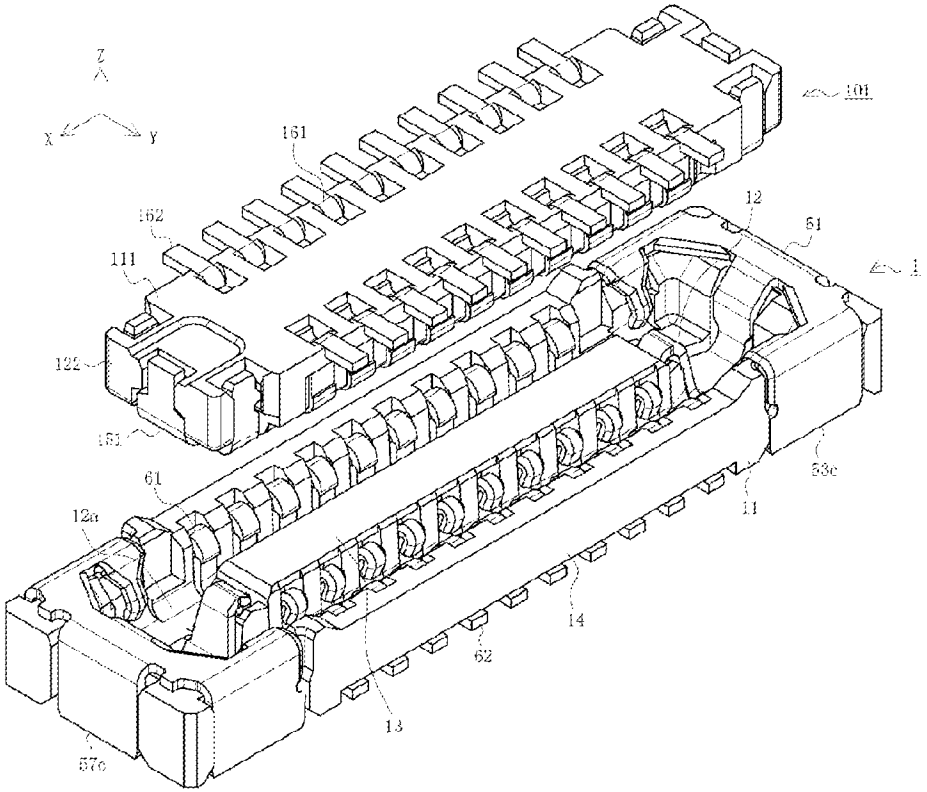
FIG. 1 is a perspective view illustrating a positional relationship between a first connector and a second connector prior to mating according to the present embodiment when viewed from the second connector side.
Figure 2:
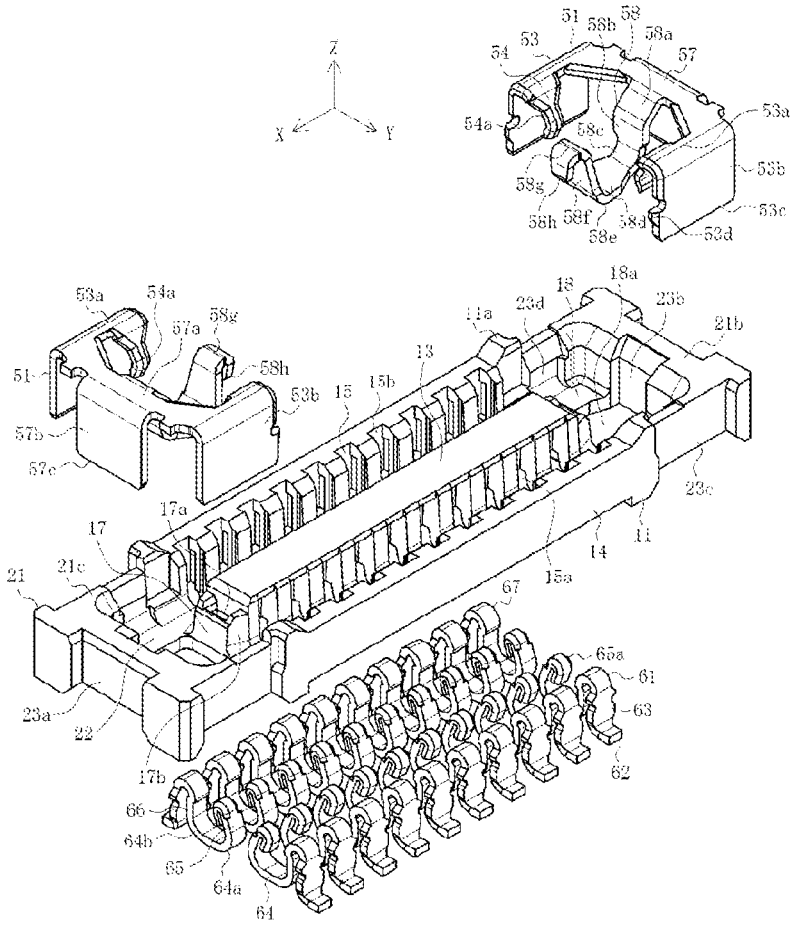
FIG. 2 is an exploded view of the first connector according to the present embodiment.
Figure 3:
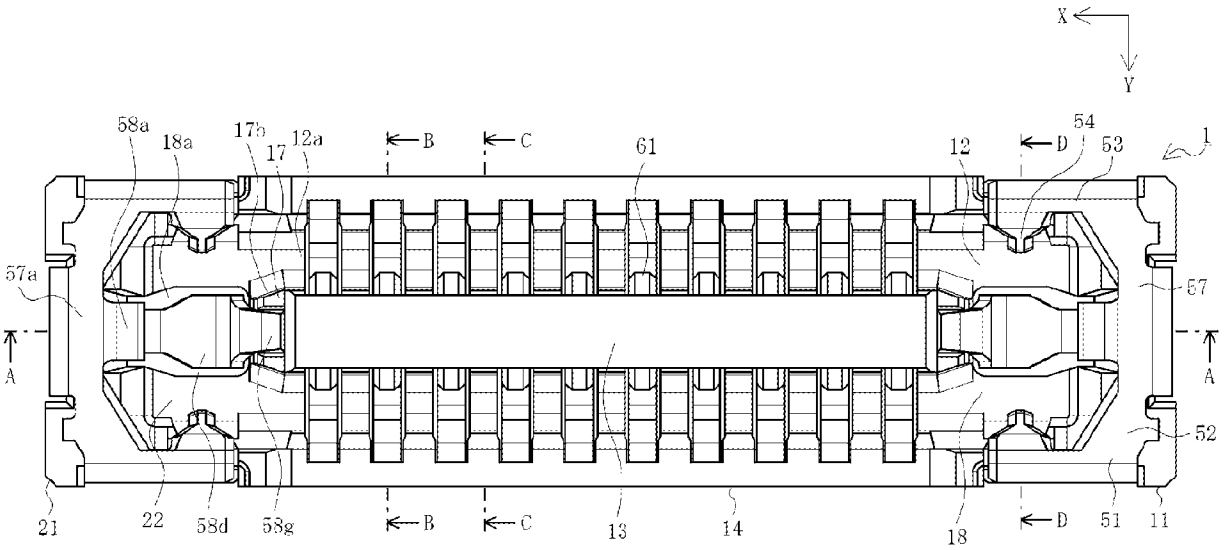
FIG. 3 is a plan view of the first connector according to the present embodiment.
Figure 4:
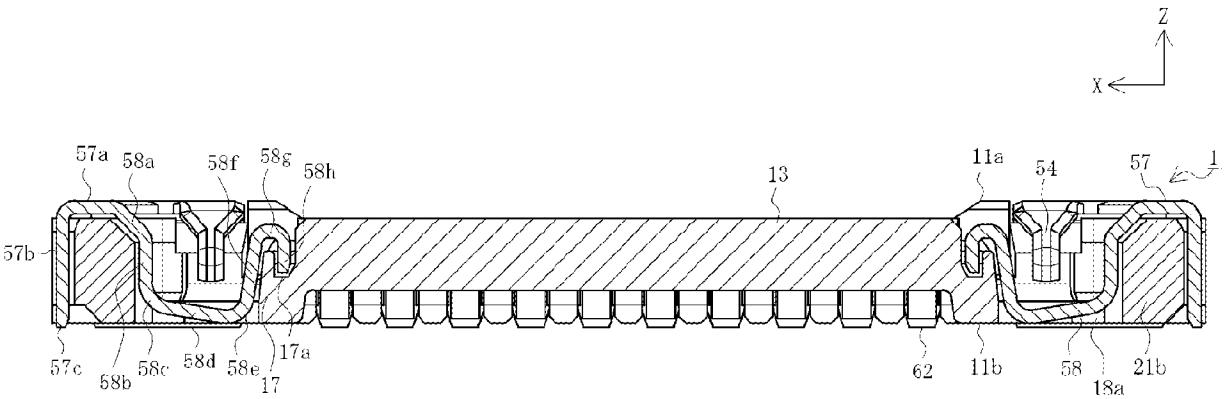
FIG. 4 is a side cross-sectional view of the first connector according to the present embodiment and is a cross-sectional view along arrows A-A in FIG. 3.
Figure 5A:
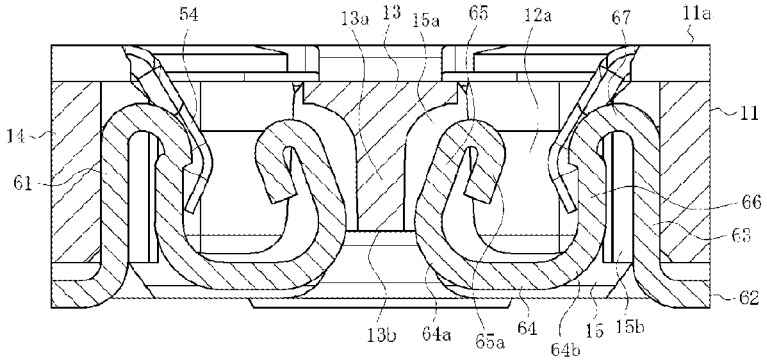
Figure 5B:
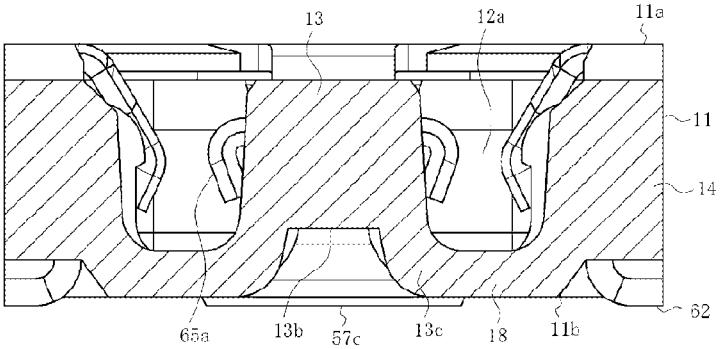
Figure 5C:
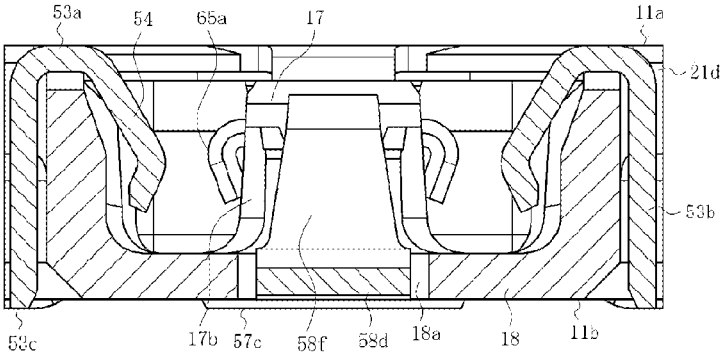

FIG. 1 is a perspective view illustrating a positional relationship between a first connector and a second connector prior to mating according to the present embodiment when viewed from the second connector side. FIG. 2 is an exploded view of the first connector according to the present embodiment. FIG. 3 is a plan view of the first connector according to the present embodiment. FIG. 4 is a side cross-sectional view of the first connector according to the present embodiment and is a cross-sectional view along arrows A-A in FIG. 3. FIGS. 5A-5C are horizontal cross-sectional views of the first connector according to the present embodiment. Note that FIG. 5A is a cross-sectional view along arrows B-B in FIG. 3, FIG. 5B is a cross-sectional view along arrows C-C in FIG. 3, and FIG. 5C is a cross-sectional view along arrows D-D in FIG. 3.

In the drawings, 1 is a connector of the present embodiment and is a first connector serving as one of a set or a pair of board-to-board connectors. The first connector 1 is a surface mount type connector mounted on the surface of a first substrate (not illustrated) that serves as a mounting member and is mated to a second connector 101 that serves as a counterpart connector. Furthermore, the second connector 101 is the other of the pair of board to board connectors and is a surface mount type connector mounted on the surface of a second substrate (not illustrated) that serves as a mounting member.

Note that while the first connector 1 and the second connector 101 are ideally used for electrically connecting the first substrate and the second substrate serving as substrates, the connectors can also be used to electrically connect other members. Examples of the first substrate and the second substrate include printed circuit boards, flexible flat cables (FFC), flexible printed circuit boards (FPC), etc. used in electronic equipment, etc., but may be any type of substrate.

Furthermore, expressions indicating directions such as up, down, left, right, front, and back used to describe the operations and configurations of the parts of the first connector 1 and the second connector 101 in the present embodiment are not absolute but rather relative directions, and though appropriate when the parts of the first connector 1 and the second connector 101 are in the positions illustrated in the figures, these directions should be interpreted differently when these positions change in order to correspond to said change.

Furthermore, the first connector 1 has a first housing 11 as a connector body integrally formed of an insulating material such as synthetic resin. As illustrated in the drawing, the first housing 11 is a substantially rectangular body having a substantially rectangular thick plate shape, wherein a first recess 12 serving as a substantially rectangular recess surrounded by a periphery and mating with a second housing 111 of the second connector 101 is formed on the side in which the second connector 101 fits—that is, on the mating face 11*a* side (Z-axis positive direction side). The first connector has, for example, dimensions of a vertical length of approximately 6.0 [mm], a horizontal width of approximately 1.5 [mm], and a thickness of approximately 0.6 [mm], however, the dimensions may be changed appropriately. In addition, a first projection 13 serving as a middle island mating with a recessed groove 113 described below inside the recess 12 is formed integrally with the first housing 11, while a side wall part 114, which extends parallel to the first projection 13 on both sides (Y-axis positive direction side and negative direction side) of the first projection 13, is formed integrally with the first housing 11.

In this case, the first projection 13 and the first side wall part 14 protrude upward from a bottom plate 18 which defines the bottom face of the recess 12 (Z-axis positive direction) and extends in the longitudinal direction (X-axis direction) of the first housing 11. Consequently, a recessed groove 12*a* serving as an elongated recess which extends in the longitudinal direction of the first housing 11 is formed as a portion of the first recess 12 on both sides of the first projection 13.

Here, first terminal housing inner cavities 15*a* with a recessed groove shape are formed in the side surfaces on both sides of the first projection 13. In addition, first terminal housing outer cavities 15*b* with a recessed groove shape are formed in the side surface inside the side wall part 14. Further, the first terminal housing inner cavities 15*a* and the first terminal housing outer cavities 15*b* are linked and formed integrally with one another on the bottom surface of the recessed groove 12*a*, so as to be described as first terminal housing cavities 15, when the first terminal housing inner cavities 15*a* and the first terminal housing outer cavities 15*b* are described in an integrated manner. Note that the first terminal housing cavities 15 are formed so as to penetrate through the bottom plate 18 in the plate thickness direction (Z-axis direction).

In the present embodiment, the first terminal housing cavities 15 are formed in rows in the longitudinal direction of the first housing 11 on both sides in the width direction (Y-axis direction) of the first housing 11. Specifically, a plurality of (for example, 10) cavities are formed on each side of the first projection 13 at a prescribed pitch (for example, approximately 0.3 [mm]). Note that the pitch and number of the first terminal hosing cavities 15 can be appropriately changed. In addition, a plurality of first terminals 61 as terminals which are housed in each of the first terminal housing cavities 15 and installed on the first housing 11 are disposed on both sides of the first projection 13 at the same pitch.

The first terminal 61 is member which is formed integrally by performing machining such as punching and bending on a conductive metal plate, and includes: a held part 63, a tail part 62 connected to the lower end of the held part 63, an upper connection part 67 connected to the upper end of the held part 63, a second contact part 66 which is connected to the lower end of the upper connection part 67 and faces the held part 63, a lower connection part connected to the lower end of the second contact part 66, and an inner connection part 65 connected to the end of the lower connection part 64 on the opposite side as the second contact part 66.

Further, the held part 63 is a portion which extends in the vertical direction (Z-axis direction)—that is, the thickness direction of the first housing 11, and is fitted and held in the first terminal housing outer cavity 15*b*. In addition, the tail part 62 is bent and connected to the held part 63 so as to extend outward in the left-right direction (Y-axis direction)—that is, the width direction of the first housing 11—and is connected to a connection pad coupled to a conductive trace of the first substrate by soldering or the like. Note that the conductive trace is typically a signal line. Further, the upper connection part 67 is a portion which is curved approximately 180 degrees so as to project upward (Z-axis positive direction).

A second contact part 66 which extends downward (Z-axis negative direction) is connected to the lower end of the upper connection part 67 on the opposite side as the held part 63. A portion of the second contact part 66 preferably projects inward in the width direction of the first housing 11. In addition, the lower connection part 64 is a portion having a substantially U-shaped side surface shape connected to the lower end of the second contact part 66. In the lower connection part 64, the portion connected to the lower end of the second contact part 66 is a lower outside curved part 64*b*, and the portion connected to the lower end of the inner connection part 65 is a lower inside curved part 64*a*. Further, a first contact part 65*a* which is curved approximately 180 degrees so as to project upward and toward the second contact part 66 is connected to the upper end of the inner connection part 65.

The first terminals 61 are fitted into the first terminal housing cavities 15 from the mounting surface 11*b*, which is the lower surface (Z-axis negative direction surface) of the first housing 11, and the held parts 63 are sandwiched from both sides by the side walls of the first terminal housing outer cavities 15*b* formed on the side surface inside the side wall part 14 so as to be fixed to the first housing 11. In this state—that is, in a state in which the first terminals 61 are mounted on the first housing 11—the first contact parts 65*a* and second contact parts 66 are positioned on both the left and right sides of the recessed groove 12*a* so as to face one another. In addition, as illustrated in FIG. 5(*a*), when viewed from the longitudinal direction (X-axis direction) of the first housing 11, most of the held part 63 is housed inside the first terminal housing outer cavity 15*b*, and most of the first contact part 65*a* is housed inside the first terminal housing inner cavity 15*a*.

Note that the first terminal 61 is a member which is integrally formed by processing a metal plate and therefore has a certain degree of elasticity. As is clear from this shape, the spacing between the first contact part 65*a* and the second contact part 66 may vary elastically. That is, when the second terminal 161 of the second connector 101 is inserted between the first contact part 65*a* and the second contact part 66, this causes the spacing between the first contact part 65*a* and the second contact part 66 to be elongated elastically.

The portion of the first projection 13 corresponding to the first terminal housing inner cavity 15*a* is a thin wall part 13*a* having a small dimension in the width direction. In addition, the lower surface 13*b* of the first projection 13 is positioned above the mounting surface 11*b*, which is the lower surface of the first housing 11. Accordingly, even when the second terminal 161 is inserted between the first contact part 65*a* and the second contact part 66 and the spacing between the first contact part 65*a* and the second contact part 66 is elongated elastically, the first terminal—more specifically, the inner connection part 65 or the lower inside curved part 64*a*—does not touch the thin wall part 13*a* of the first projection 13. Note that, as illustrated in FIG. 5(*b*), the dimension in the width direction of the portion of the first projection 13 not corresponding to the first terminal housing inner cavity 15*a* is not reduced, and the lower end thereof is connected to the bottom plate 18 which defines the bottom surface of the recessed grooves 12*a* on both sides via the connection ends 13*c*.

Moreover, each first protruding end part 21 as a mating guide part is disposed on both ends in the longitudinal direction of first housing 11. Mating recess 22 as a portion of recess 12 is formed on each first protruding end part 21. The mating recess 22 is a substantially rectangular recess connected to both ends in the longitudinal direction of each recessed groove 12*a*. Additionally, in the state in which the first connector 1 and the second connector 101 are mated, a second protruding end part 122 contained in second connector 101 is inserted into the mating recess 22.

Further, the first protruding end part 21 includes: a side wall extension 21*c* serving as a side wall part of the first protruding end part 21 extending in the longitudinal direction of the first housing 11 from both sides in the longitudinal direction of the side wall part 14, and an end wall part 21*b* which extends in the width direction of the first housing 11 and is connected at both ends to the side wall extension 21*c*. In each first protruding end part 21, the first end wall part 21*b* and the side wall extension 21*c* connected to both ends thereof form a continuous substantially U-shaped side wall and define three sides of a substantially rectangular mating recess 22. Further, in the first end wall part 21*b*, a concave outer end recess 23*a* is formed in the outer surface, and a concave inner end recess 23*b* is formed in the inner surface. In addition, in the side wall extension 21*c*, a concave outer recess 23*c* is formed in the outer surface, and a concave inner recess 23*d* is formed in the inner surface.

Further, an island end recess 17*a* which is recessed downward is formed in the upper surface of an island end part 17, which is the end of the first projection 13 in the longitudinal direction of the first housing 11. Note that in a plan view, the island end side surfaces 17*b* facing the side wall parts 14 on both sides of the island end part 17 are inclined surfaces so that the dimension in the width direction of the island end part 17 gradually decreases toward the end wall part. In addition, a bottom plate 18 which defines the bottom face of the mating recess 22 has a bottom opening 18*a* formed so as to penetrate the bottom plate 18 in the plate thickness direction. The bottom opening 18*a* is formed so as to connect the lower end of the inner end recess 23*b* of the end wall part 21*b* and the lower end of the surface of the island end part 17 facing the end wall part 21*b*.

A first reinforcing bracket 51 serving as a reinforcing bracket mounted on the first housing 11 is attached to the first protruding end part 21. In the present embodiment, the first reinforcing bracket 51 is a member which is formed integrally by performing machining such as punching and bending on a metal plate, and includes: an end wall cover part 57 serving as a main body which covers the outside of the end wall part 21 of the first protruding end 21, arm parts 53 connected to both the left and right ends of the end wall cover part 57, contact arm parts 54 connected to the connection arm parts 53, and a central guide part 58 connected to the center of the end wall cover part 57. Note that since the first reinforcing bracket is a member formed integrally by machining a metal plate, it has a certain degree of elasticity.

The end wall cover part 57 includes an end wall upper cover part 57*a* which extends in the width direction of the first housing 11 on the whole and covers most of the upper surface of the end wall part 21*b*, and an end wall outer cover part 57*b* which extends downward from the outer edge of the end wall part 21*b* of the end wall upper cover part 57*a*. Note that in a state in which the first reinforcing bracket 51 is attached to the first protruding end part 21, the end wall outer cover part 57*b* is housed in the outer end recess 23*a*, and as illustrated in FIG. 5(*c*), the lower end part 57*c* of the end wall outer cover part 57*b* projects downward from the mounting surface 11*b* of the first housing 11 and is connected to a connection pad of the first substrate by soldering or the like.

In addition, the connection arm part 53 includes a side wall upper cover part 53*a* which extends toward the center in the longitudinal direction of the first housing 11 from both the left and right ends of the end wall upper cover part 57*a* and covers most of the upper surface of the side wall extension 21*c*, and a side wall outer cover part 53*b* which extends downward from the outer edge of the side wall extension 21*c* of the side wall upper cover part 53*a*.

The contact arm part 54 extends downward from the outer edge of the side wall extension 21*c* of the side wall upper cover part 53*a* within the mating recess 22. Further, the contact arm part 54 includes a contact part 54*a* which bulges inward in the width direction of the first housing 11. In a state in which the first connector 1 and the second connector 101 are mated, the contact part 54*a* comes into contact with the second reinforcing bracket 151 of the second connector 101. Note that in a state in which the first reinforcing bracket 51 is attached to the first protruding end part 21, the contact arm part 54 faces the inner recess 23*d* and the side wall outer cover part 53*b* is housed inside the outer recess 23*c*, and as illustrated in FIG. 5C, the lower end part 53*c* of the side wall outer cover part 53*b* projects downward from the mounting surface 11*b* of the first housing 11 and is connected to a connection pad of the first substrate by soldering or the like. The connection pads are preferably coupled to conductive traces of the first substrate, which function as power lines. In addition, a holding projection 53*d* for holding the first reinforcing bracket 51 by cutting into the first housing 11 is preferably formed on the front end of the side wall outer cover part 53*b*.

Further, as illustrated in FIG. 4, the central guide part 58 is a band-like plate material which is bent so as to have a substantially U-shaped side surface shape when viewed from the width direction (Y-axis direction) of the first housing 11, and extends in the longitudinal direction of the first housing 11 along the inside of the mating recess 22. The central guide part 58 includes: an inclined part 58*a* having a base which is connected to the inner edge of the side wall part 21*b* of the end wall upper cover part 57*a* and extends diagonally downward from the inner edge of the end wall part 21*b*; a first vertical part 58*b* serving as a vertical part extending downward from the lower end of the inclined part 58*a*; a first curved part 58*c* serving as an end wall side curved part which is curved approximately 90 degrees and is connected to the lower end of the first vertical part 58*b*; a bottom part 58*d* which extends from the first curved part 58*c* toward the center in the longitudinal direction of the first housing 11; a second curved part 58*e* serving as an island side curved part which is curved approximately 90 degrees and is connected to the end of the bottom part 58*d* on the opposite side as the first curved part 58*c*; a second vertical part 58*f* serving as an island end outer cover part which extends upward from the second curved part 58*e*; an island upper cover part 58*g* which is connected to the upper end of the second vertical part 58*f* and is curved approximately 180 degrees so as to project upward; and a tip 58*h* serving as an engaging end part which extends downward from the end of the island end upper cover part 58*g* on the opposite side as the second vertical part 58*f*. The inclined part 58*a* and the first vertical part 58*b* cooperatively function as an end wall inner cover part which covers at least a portion of the inside of the end wall part 21*b*, and the second vertical part 58*f* and the island end upper cover part 58*g* cooperatively function as an island end cover part which covers at least a portion of the island end part 17.

Note that in a state in which the first reinforcing bracket 51 is attached to the first protruding end 21, the inclined part 58*a* and the first vertical part 58*b* are housed inside the inner end recess 23*b*, the bottom part 58*d* is housed inside the bottom opening 18*a*, and at least the lower end of the tip 58*h* engages with the island end recess 17*a* and is housed inside the island end recess 17*a*. As a result, the upper surface of the island end part 17 and the side surface facing the end wall part 21*b* are covered and protected by the second vertical part 58*f* and the island end upper cover part 58*g*. In addition, the lower surface of the second curved part 58*e* is positioned substantially identically to or slightly above the mounting surface 11*b* of the first housing 11, and the lower surface of the first curved part 58*c* is positioned above the lower surface of the second curved part 58*e*, while the bottom part 58*d* is inclined diagonally downward from the first curved part 58*c* toward the second curved part 58*e*. Further, as illustrated in FIG. 3, the bottom part 58*d* preferably has a larger dimension in the width direction (Y-axis direction)—that is, greater width—than the other portions of the central guide part 58. As a result, the deformation of the bottom part 58*d* is effectively prevented.

Next, the configuration of the second connector 101 will be described.

Figure 6:
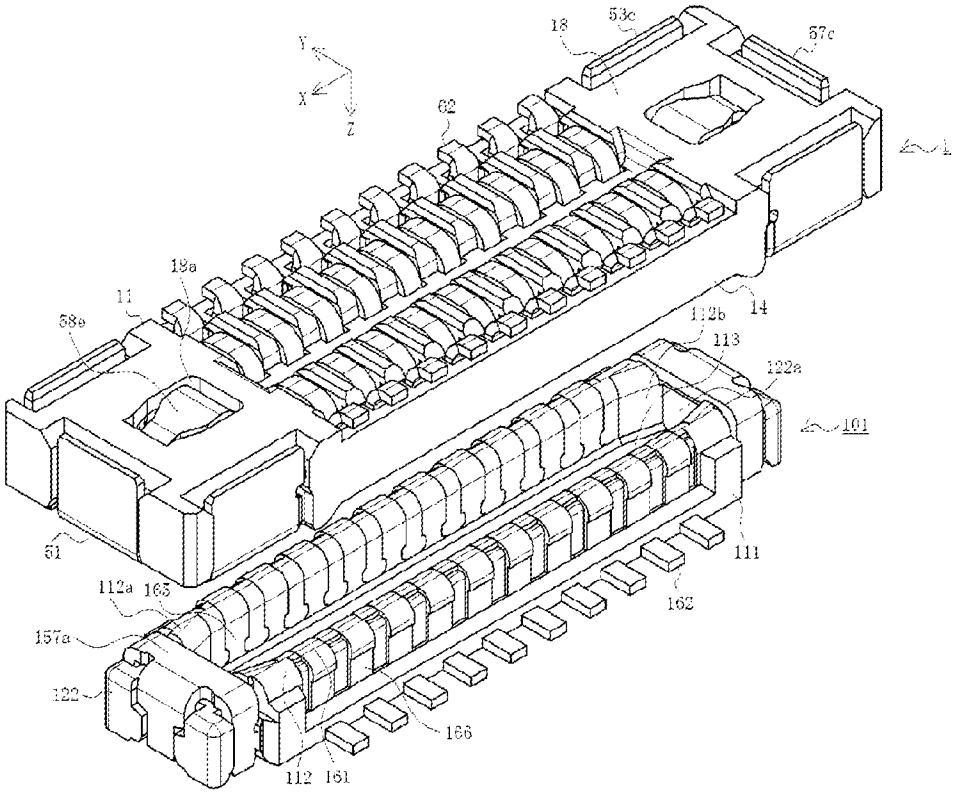
FIG. 6 is a perspective view illustrating the positional relationship between the first connector and the second connector prior to mating according to the present embodiment when viewed from the first connector side.
Figure 7:
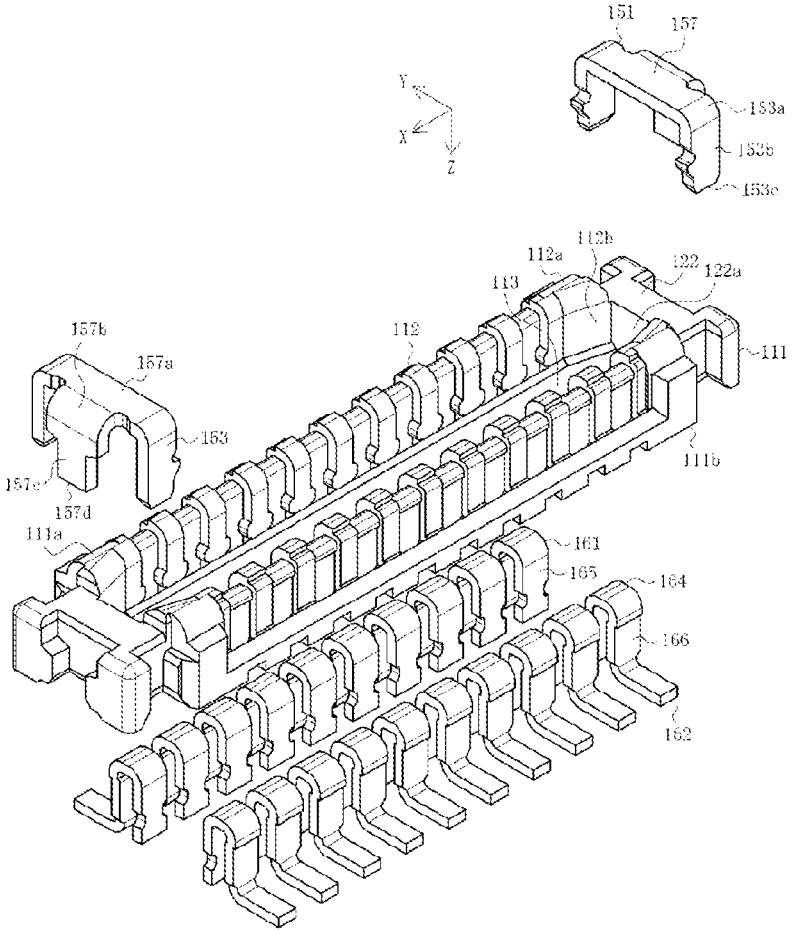
FIG. 7 is an exploded view of the second connector according to the present embodiment.
Figure 8:
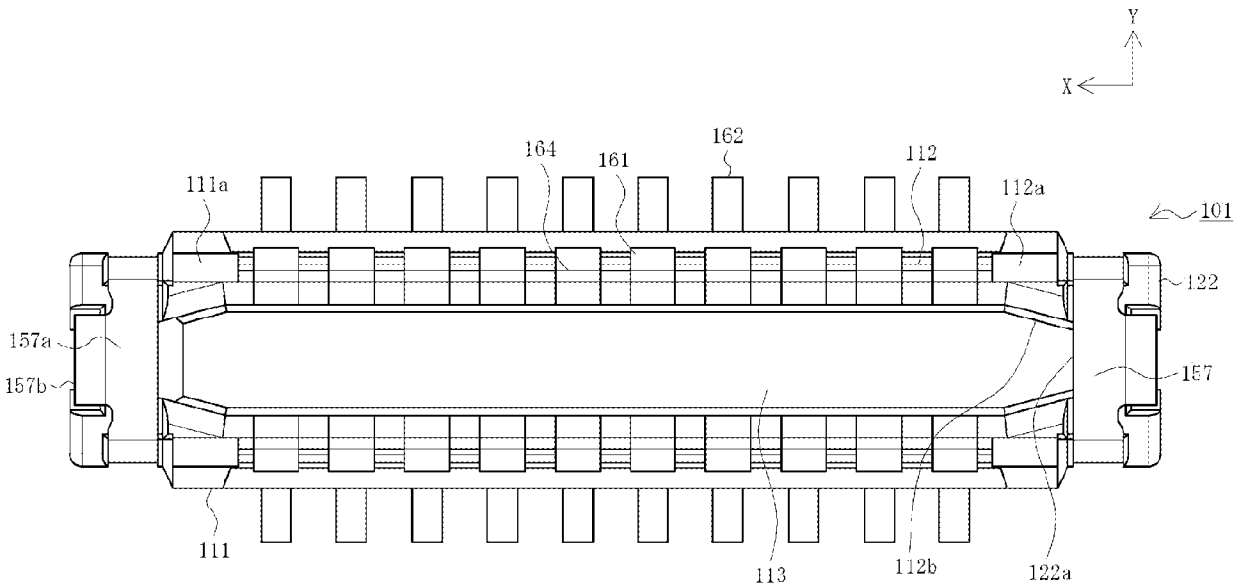
FIG. 8 is a plan view of the second connector according to the present embodiment.

FIG. 6 is a perspective view illustrating the positional relationship between a first connector and a second connector prior to mating according to the present embodiment when viewed from the first connector side. FIG. 7 is an exploded view of the second connector according to the present embodiment. FIG. 8 is a plan view of the second connector according to the present embodiment.

The second connector 101 as a counterpart connector according to the present embodiment has the second housing 111 as a counterpart connector body integrally formed of an insulating material such as synthetic resin. As illustrated in the figure, this second housing 111 is a substantially rectangular body with the shape of a substantially rectangular thick plate. In addition, an elongated recessed groove 113 extending in the longitudinal direction (X-axis direction) of the second housing 111, and a second projection 112 serving as an elongated projection, which defines the outside of the recessed groove 113 and extends in the longitudinal direction of the second housing 111, are integrally formed on the side of the second housing 111 which is fitted into the first connector 1—that is, the mating surface 111*a* side (Z-axis negative direction side). The second projection 112 is formed along both sides of the recessed groove 113 and along both sides of the second housing 111. The second connector 101 has, for example, dimensions of a vertical length of approximately 5.2 [mm], a horizontal width of approximately 1.0 [mm], and a thickness of approximately 0.5 [mm], however, the dimensions may be changed appropriately.

In addition, a second terminal 161 is disposed as a counterpart terminal in each second projection 112. The second terminal 161 is disposed at the pitch corresponding to the first terminal 61 and in the number corresponding thereto. The recessed groove 113 is closed by a bottom plate 111*b* on the side mounted to a second substrate—that is, the mounting surface 111*b* side (Z-axis positive direction side).

Moreover, each second protruding end part 122 as a counterpart mating guide part is disposed on both ends in the longitudinal direction of the second housing 111. The second protruding end part 122 is a thick member which extends in the width direction (Y-axis direction) of the second housing 111 and is connected to both ends in the longitudinal direction of each projection 112, and the upper surface thereof has a substantially rectangular shape. Additionally, in the state in which the first connector 1 and the second connector 101 are mated, the second protruding end part 122 functions as an insertion protrusion inserted into the mating recess 22 of the first protruding end part 21 contained in the first connector 1. In addition, a second reinforcing bracket 151 is attached as a counterpart reinforcing bracket to the second protruding end part 122.

Note that since the second terminals 161 and the second reinforcing brackets 151 are formed integrally with the second housing 111 by a molding method called overmolding or insert molding, these portions do not exist in a state separated from the second housing 111, however, for the sake of explanatory convenience, these portions are depicted separately from the second housing 111 in FIG. 7.

The second terminal 161 is a member which is formed integrally by performing machining such as punching and bending on a conductive metal plate, and includes: a first contact part 165, a connection part connected to the upper end of the first contact part 165, a second contact part 166 connected to the outer end of the connection part 164, and a tail part 162 connected to the lower end of the second contact part 166. The tail part 162 extends toward the outside of the second housing 111 and is connected to a connection pad coupled with a conductive trace of the second substrate by soldering or the like. Note that the conductive trace is typically a signal line. In addition, the surfaces of the first contact part 165, the connection part 164, and the second contact part 166 are exposed to each side surface of the second projection 112 and the mating surface 111*a*.

The second reinforcing bracket 151 is a member which is formed integrally by performing machining such as punching and bending on a metal plate, and includes: a central covering part 157 serving as a main body which covers the outside of the second protruding end part 122, and side covering parts 153 connected to both the left and right ends of the central covering part 157.

The central covering part 157 includes: a protruding end upper cover part 157*a* which extends in the width direction of the second housing 111 on the whole and covers most of the upper surface of the second protruding end part 122; a connection cover part 157*b* which is curved approximately 90 degrees and is connected to the outer edge of the second protruding end part 122 of the protruding end upper cover part 157*a*; and a protruding end outer cover part 157*c* which extends downward from the lower end of the connection cover part 157*b*. Note that the lower end part 157*d* of the protruding end outer cover part 157*c* is connected to a connection pad of the second substrate by soldering or the like.

In addition, the side cover part 153 includes connection cover parts 153*a* which are curved approximately 90 degrees and are connected to both the left and right ends of the protruding end upper cover part 157*a*, and side cover parts 153*b* which extend downward from the lower ends of the connection cover parts 153*a*. The lower end part 153*c* of the side cover part 153*b* is connected to a connection pad of the second substrate by soldering or the like. The connection pads are preferably coupled to conductive traces of the first substrate, which function as power lines.

Note that the inner surface 122*a* of the second protruding end part 122 is not covered by the second reinforcing bracket 151. In addition, as illustrated in FIG. 8, the protruding end connection part 112*a*, which is a portion connected to the second protruding end part 122 at both ends in the longitudinal direction of the second projection 112, is formed so that the thickness (dimension in the Y-axis direction) gradually increases toward the second protruding end part 122 in a plan view. As a result, the protruding end connection part 112*a* has enhanced strength and is less prone to breakage. In addition, as a result, the inner surfaces 112*b* of the protruding end connection parts 112*a* on both the left and right sides are inclined surfaces in which distance therebetween gradually decreases towards the second protruding end part 122 in a plan view. Note that the angle of inclination of the inside surface 112*b* preferably corresponds to the angle of inclination of the island end side surface 17*b* of the island end part 17 of the first housing 11.

The operation for mating the first connector 1 and the second connector 101 having the abovementioned configuration will be described next.

Figure 9A:
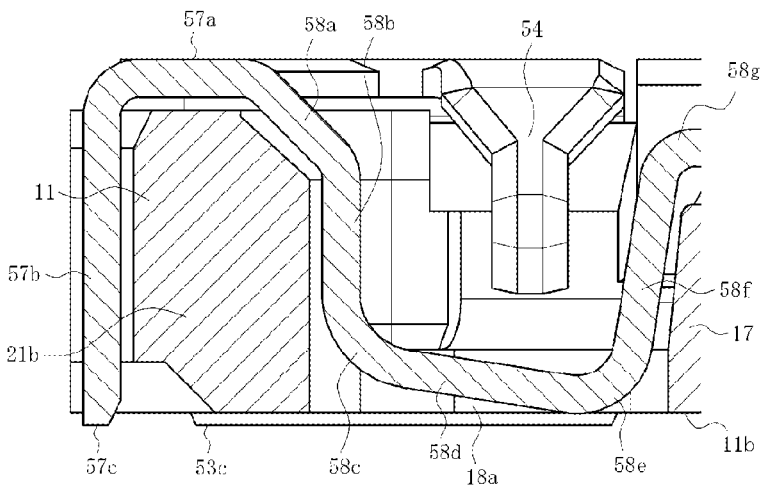
Figure 9B:
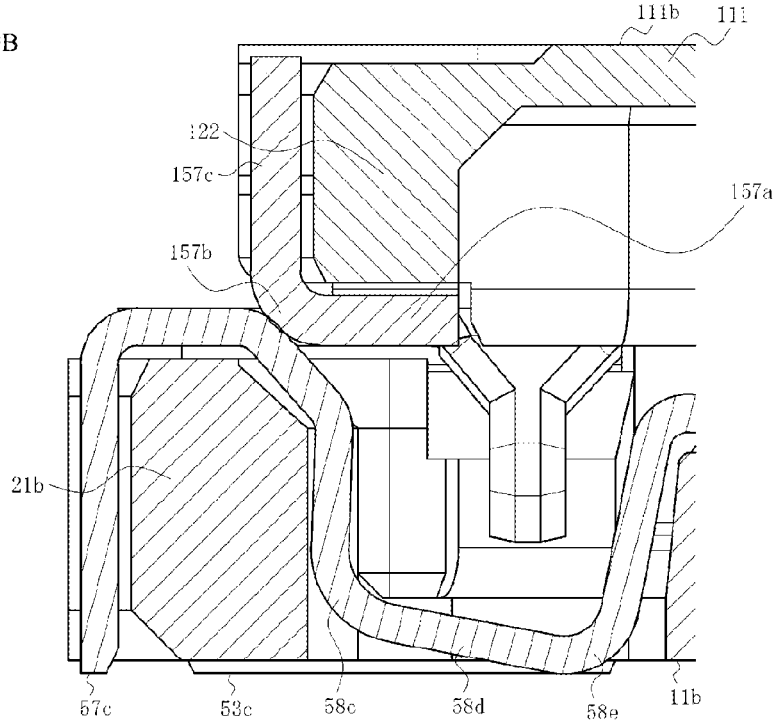
Figure 10A:
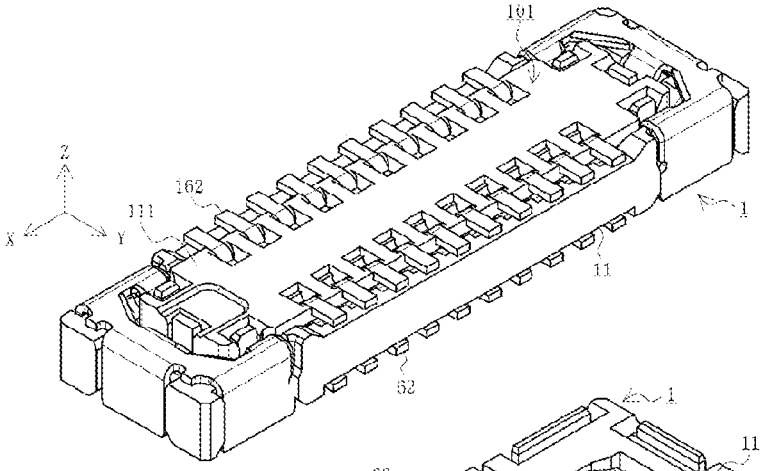
Figure 10B:
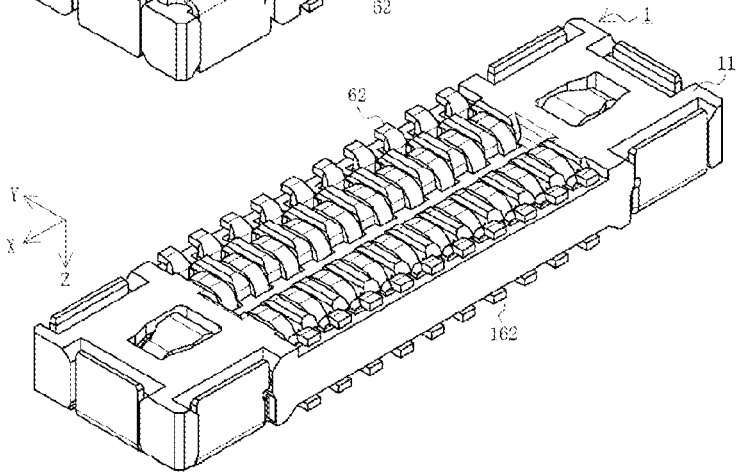
Figures 11A, 11B:
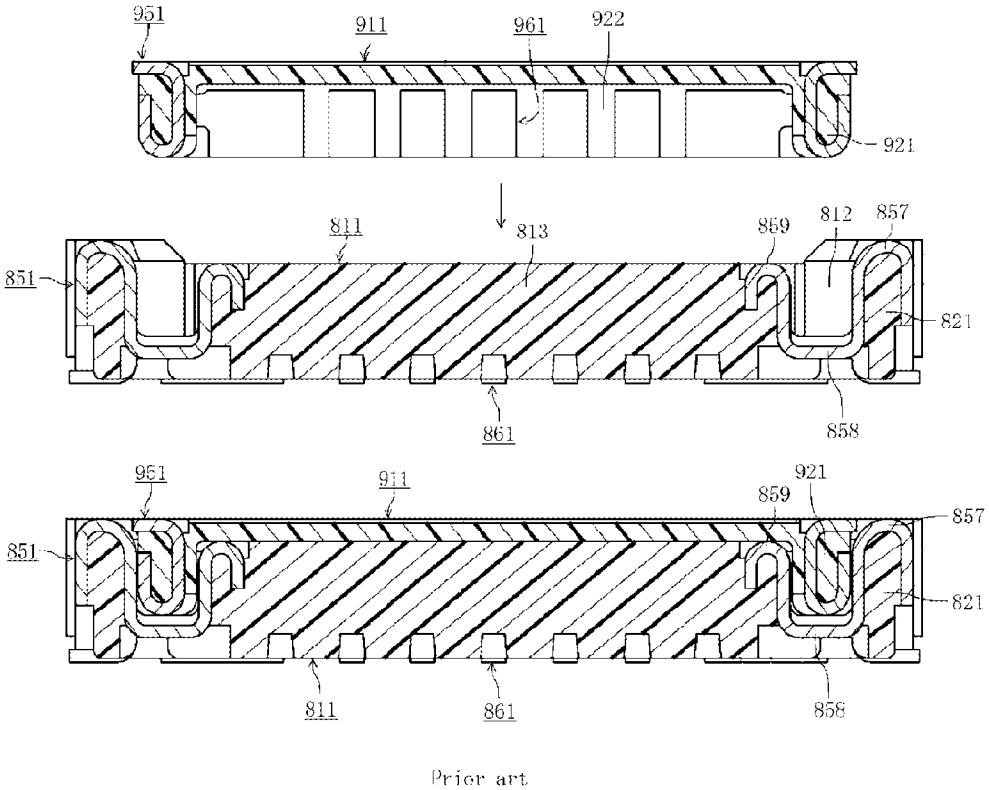
FIG 11A Prior Art

FIGS. 9A and 9B are enlarged views of the relevant parts of the side cross-section of the first connector and the second connector according to the present embodiment, and FIGS. 10A and 10B are perspective views illustrating a state in which the first connector and the second connector are mated in the present embodiment. Note that FIG. 9A is an enlarged view of the portion near the left end in FIG. 4, and FIG. 9B is a view of the portion corresponding to FIG. 9A when the first connector and the second connector are mated in a displaced state in the X-axis direction. FIG. 10A is a view from the second connector side, and FIG. 10B is a view from the first connector side.

Here, the first connector 1 is mounted to the surface of the first substrate by connecting the tale parts 62 of the first terminals 61 to connection pads coupled to conductive traces of the first substrate (not illustrated) by soldering or the like, connecting the lower end part 53*c* of the side wall outer cover part 53*b* of the first reinforcing bracket 51 to connection pads coupled to conductive traces of the first substrate by soldering or the like, and connecting the lower end part 57*c* of the end wall outer cover part 57*b* of the first reinforcing bracket 51 to connection pads of the first substrate by soldering or the like. Note that the conductive traces coupled to the connection pads to which the tail parts 62 of the first terminals 61 are connected are signal lines, while the conductive traces coupled to the connection pads to which the lower end part 53*c* of the side wall outer cover part 53*b* of the first reinforcing bracket 51 is connected are power lines.

Similarly, the second connector 101 is mounted to the surface of the second substrate by connecting the tail parts 162 of the second terminals 161 to connection pads coupled to conductive traces of the second substrate (not illustrated) by soldering or the like, connecting the lower end part 153*c* of the side cover part 153*b* of the second reinforcing bracket 151 to the connection pads coupled to conductive traces of the second substrate by soldering or the like, and connecting the lower end part 157*d* of the protruding end outer cover part 157*c* of the second reinforcing bracket 151 to connection pads of the second substrate by soldering or the like. Note that the conductive traces coupled to the connection pads to which the tail parts 162 of the first terminals 161 are connected are signal lines, while the conductive traces coupled to the connection pads to which the lower end part 153*c* of the side cover part 153*b* of the second reinforcing bracket 151 is connected are power lines.

First, an operator places the mating surface 11*a* of the first housing 11 of the first connector 1 and the mating surface 111*a* of the second housing 111 of the second connector 101 in a state facing one another, and when the position of the second projection 112 of the second connector 101 is aligned with the position of the corresponding recessed groove 12*a* of the first connector and the second protruding end part 122 of the second connector 101 is aligned with the position of the corresponding mating recess 22 of the first connector, the alignment of the first connector 1 and the second connector 101 is complete.

In this state, if the first connector 1 and/or the first connector 101 moves in the direction approaching the counterpart side—that is, the mating direction (Z-axis direction)—then the second projection 112 and the second protruding end part 122 of the second connector 101 are inserted into the recessed groove 112*a* and the mating recess 22 of the first connector 1. As a result, when the first connector 1 and the second connector 101 are mated, the first terminals 61 and the second terminals 161 are in a conductive state.

Specifically, each second terminal 161 of the second connector 101 is inserted between the first contact part 65*a* and the second contact part 66 of each first terminal 61 so that the first contact part 65*a* of the first terminal 61 comes into contact with the first contact part 165 of the second terminal 161 and the second contact part 66 of the first terminal 61 comes into contact with the second contact part 166 of the second terminal 161. As a result, the conductive traces coupled to the connection pads on the first substrate to which the tail parts 62 of the first terminals 61 are connected become conductive with the conductive traces coupled to the connection pads on the second substrate to which the tail parts 162 of the second terminals 161 are connected.

In addition, the second protruding end part 122 is inserted into the mating recess 22 so that the contact part 54*a* of the contact arm part 54 of the first reinforcing bracket 51 comes into contact with the side cover part 153*b* of the second reinforcing bracket 151 attached to the second protruding end part 122. As a result, the conductive traces coupled to the connection pads on the first substrate to which the lower end part 53*c* of the side wall outer cover part 53*b* of the first reinforcing bracket 51 is connected become conductive with the conductive traces coupled to the connection pads on the second substrate to which the lower end part 153*c* of the side cover part 153*b* of the second reinforcing bracket 151 is connected.

Incidentally, since the first connector 1 and the second connector 101 are respectively mounted on the first and second substrates, which have wide areas, an operator cannot visually observe the mating surface of the first connector 1 and the mating surface of the second connector 101 and must perform the mating operation by trial and error. As a result, accurate alignment cannot be achieved due to the operation by trial and error, and the position of the first connector 1 and the position of the second connector 101 may be misaligned. For example, the second connector 101 may be misaligned in the X-axis direction with respect to the first connector 1, resulting in a state in which one of the first protruding end parts 21 of the first connector 1 and one of the second protruding end parts 122 of the second connector 101 face one another.

In such a state, even if the operator moves the first connector 1 and/or the second connector 101 in the mating direction, a so-called self-alignment function is activated in the present embodiment, because the central guide part 58 of the first reinforcing bracket 51 attached to the first protruding end part 21 has inclined part 58*a* which is inclined and the central covering part 157 of the second reinforcing bracket 151 attached to the second protruding end part 122 has a curved connection cover part 157*b*, which causes the first connector 1 and the second connector 101 to be aligned automatically and makes it possible for the first connector 1 and the second connector 101 to be mated. For example, if the amount of misalignment of the second connector 101 in the X-axis direction with respect to the first connector 1 is less than or equal to 1 pitch of the first terminals 61 and the second terminals 161, as illustrated in FIG. 9B, the curved connection cover part 157*b* of the central covering part 157 of the second reinforcing bracket 151 attached to the second protruding end part 122 comes into contact with the inclined part 58*a* of the central guide part 58 of the first reinforcing bracket 51 attached to the first protruding end part 21, and the inclined part 58*a* functions as a guiding surface so that the connection cover part 157*b* slides smoothly in the diagonally downward direction in the drawing along the inclined part 58*a*. As a result, the first connector 1 and the second connector 101 are aligned automatically, and the second protruding end part 122 of the second connector 101 is housed inside the corresponding mating recess 22 of the first connector 1 so that the first connector 1 and the second connector 101 are mated.

In this case, the central guide part 58 receives a downward force from the central covering part 157 and is therefore displaced elastically in the downward direction, however, the lower surface of the second curved part 58*e* comes into contact with the surface of the first substrate having connection pads to which the lower end part 53*c* of the side wall outer cover part 53*b* is connected, which stops the displacement in the downward direction. Accordingly, even when subjected to a large pressing force from the central covering part 157, the pressing force is transmitted to the first substrate from the lower surface of the second curved part 58*e* of the central guide part 58, and therefore, the first vertical part 58*b* does not press against and damage or break the inner surface of the end wall part 21*b*, and the second vertical part 58*f* or the island end upper cover part 58*g* does not press against and damage or break the island end part 17. Note that the other protruding end part 122 of the second connector 101 comes into contact with the upper surface of the first projection 13 of the first connector 1 and is displaced toward the island end part 17 on the side of the other first protruding end part 21, however, the island end part 17 is not damaged or broken because it is protected by the second vertical part 58*f* and the island end upper cover part 58*f*.

In addition, since the island end side surface 17*b* of the island end part 17 of the first housing 11 and the inner surface 112*b* of the protruding end connection part 112*a* of the second housing 111 are inclined in a plan view and function as guiding surfaces for one another, even if the second connector 101 is misaligned in the Y-axis direction with respect to the first connector 1, a so-called self-alignment function is activated, which causes the first connector 1 and the second connector 1 to be aligned automatically and makes it possible for the first connector 1 and the second connector 101 to be mated.

Further, since the first reinforcing bracket 51 is attached to the first protruding end part 21, and the end wall part 21*b* and most of the upper surface (Z-axis positive direction surface) of the side wall extension 21*c* connected to both ends thereof are covered by the end wall covering part 57 and the connection arm part 53, even if subjected to a large pressing force from the second protruding end part 122, the pressing force is transmitted to the first substrate through the lower end part 57*c* of the end wall cover part 57 and the lower end part 53*c* of the connection arm part 53 and is negligibly transmitted to the end wall part 21*b* and the side wall extension 21*c*. Accordingly, the end wall part 21*b* and the side wall extension 21*c* are not damaged or broken.

As described above, in the present embodiment, the first connector 1 includes the first housing 11, the first terminal 61 installed in the first housing 11, and the first reinforcing bracket 51 installed on the first housing 11. The first housing 11 includes: a recess 12 which mates with the second housing 111 of the second connector 101, a first projection 13 inside the recess 12 which mates with the recessed groove 113 of the second housing 111, and a first protruding end 21 which is formed on both ends in the longitudinal direction and on which a mating recess 22 is formed into which the second protruding end part 122 formed on both ends in the longitudinal direction of the second housing 111 is inserted; the first reinforcing bracket 51 includes an end wall cover part 57 disposed on an end wall part 21*b* of the first protruding end part 21, and a central guide part 58 which is connected to the end wall cover part 57, which has a tip 58*h* which engages with the island end part 17 of the first projection 13, and which extends in the longitudinal direction of the first housing 11 along the inside of the mating recess 22; and the central guide part includes an inclined part 58*a* and a first vertical part 58*b* serving as an end wall inner cover part connected to the end wall cover part 57, a second vertical part 58*f* and an island end upper cover part 58*g* serving as an island cover part which covers at least a portion of the island end part 17, and a bottom part 58*d* which is connected to the lower end of the inclined part 58*a* and the first vertical part 58*b* via the first curved part 58*c* and which is connected to the lower end of the second vertical part 58*f* and the island end upper cover part 58*g* via the second curved part 58*e*; wherein the lower surface of the first curved part 58*c* is positioned above the lower surface of the second curved part 58*e*.

As a result, even when subjected to a large pressing force from the second connector 101 during the mating operation, the pressing force is transmitted to the first substrate from the lower surface of the second curved part 58*e* of the central guide part 58, and therefore, the first vertical part 58*b* does not press against and damage or break the inner surface of the end wall part 21*b*, and the second vertical part 58*f* or the island end upper cover part 58*g* does not press against and damage or break the island end part 17. In addition, the island end part 17, which is the end part of the first housing 11 in the longitudinal direction of the first projection 13, is not damaged or broken because it is appropriately protected by the second vertical part 58*f* and the island upper cover part 58*g*. Therefore, the protected state of the first housing 11 is maintained with certainty, and the reliability is enhanced.

In addition, a bottom plate 18 which defines the bottom face of the mating recess 22 has a bottom opening 18*a* formed so as to penetrate the bottom plate 18 in the plate thickness direction, and the bottom part 58*d* is housed inside the bottom opening 18*a*, while the second curved part 58*e* is exposed to the mounting surface 11*b* of the first housing 11. Therefore, even if subjected to a large pressing force from the second connector 101 during the mating operation, the first housing 11 including the bottom plate 18 will not be damaged or broken.

Further, the bottom part 58*d* is wider than other portions of the central guide part 58. Even if subjected to a large pressing force from the second connector 101 during the mating operation, the bottom part 58 does not deform, and therefore, the pressing force is appropriately transmitted to the first substrate from the lower surface of the second curved part 58*e* of the central guide part 58.

Further, the end wall inner cover part includes an inclined part 58*a* having a base end connected to the end wall cover part 57 and extending diagonally downward. Therefore, even if the second connector 101 is misaligned in the X-axis direction with respect to the first connector 1 during the mating operation, a self-alignment function is activated, which causes the first connector 1 and the second connector 101 to be aligned automatically.

Further, when the second reinforcing bracket 151 attached to the second protruding end part 122 of the second housing 111 comes into contact with the inclined part 58*a*, the second reinforcing bracket 151 slides along the inclined part 58*a*, and the second protruding end part 122 is guided into the mating recess 22. Accordingly, the second protruding end part 122 of the second connector 101 is housed smoothly inside the corresponding mating recess 22 of the first connector 1, and the first connector 1 and the second connector 101 are therefore mated smoothly.

Further, the first reinforcing bracket 51 includes a connecting arm part 53 which is connected to both the left and right ends of the end wall cover part 57 and extends in the longitudinal direction of the first housing 11, and a contact arm part 54 which extends downward within the mating recess 22, and the contact arm part 54 includes a contact part 54*a* which comes into contact with the second reinforcing bracket 151 attached to the second protruding end part 122 inserted into the mating recess 22. As a result, the first reinforcing bracket 51 can function as a connection terminal for the power lines.

Further, the island end side surfaces 17*b* on both sides of the island end part 17 are inclined surfaces such that the dimension in the width direction of the island end part 17 gradually decreases toward the end wall part 21*b* in a plan view. Therefore, even if the second connector 101 is misaligned in the X-axis direction with respect to the first connector 1, a so-called self-alignment function is activated, which causes the first connector 1 and the second connector 101 to be aligned automatically.

Note that the disclosure of the present specification describes characteristics related to a preferred and exemplary embodiment. Various other embodiments, modifications and variations within the scope and spirit of the claims appended hereto could naturally be conceived by persons skilled in the art by summarizing the disclosures of the present specification.

The invention claimed is:

1. A connector comprising: a connector body, a terminal mounted on the connector body, and a reinforcing bracket mounted on the connector body; wherein:

the connector body includes a recess which is configured to mate with a counterpart connector body of a counterpart connector, a middle island inside the recess which is configured to mate with a recessed groove of the counterpart connector body, and a mating guide part which is formed on both ends in a longitudinal direction and on which a mating recess is formed into which a counterpart mating guide part formed on both ends in a longitudinal direction of the counterpart connector body is configured to be inserted;

the reinforcing bracket includes a main body part disposed on an end wall of the mating guide part, and a central guide part which is connected to the main body part, which has a tip which engages with an island end of the middle island, and which extends in a longitudinal direction of the connector body along an inside of the mating recess; and the central guide part includes an end wall inner cover part connected to the main body part, an island end cover part which is connected to the tip and covers at least a portion of the island end, and a bottom part which is connected to a lower end of the end wall inner cover part via a first curved part and is connected to a lower end of the island end cover part via a second curved part;

wherein the bottom part extends angularly downwardly in the longitudinal direction from the first curved part to the second curved part such that a lower surface of the first curved part is positioned above a lower surface of the second curved part.

2. The connector according to claim 1, wherein a bottom plate which defines a bottom face of the mating recess has a bottom opening formed so as to penetrate the bottom plate in a plate thickness direction; the bottom part is housed inside the bottom opening; and the second curved part is exposed to a lower surface of the connector body.

3. The connector according to claim 1, wherein the bottom part is wider than other portions of the central guide part.

4. The connector according to claim 1, wherein the end wall inner cover part includes an inclined part having a base end connected to the main body part and extending diagonally downward.

5. The connector according to claim 4, wherein the inclined part is configured such that when a counterpart reinforcing bracket attached to the counterpart mating guide part of the counterpart connector body comes into contact with the inclined part, the counterpart reinforcing bracket slides along the inclined part, and the counterpart mating guide part is guided into the mating recess.

6. The connector according to claim 1, wherein: the reinforcing bracket further includes a connecting arm part which is connected to both left and right ends of the main body part and extends in the longitudinal direction of the connector body, and a contact arm part which is connected to the connecting arm part and extends downward within the mating recess; and the contact arm part includes a contact part which is configured to make contact with a counterpart reinforcing bracket attached to the counterpart mating guide part inserted into the mating recess.

7. The connector according to claim 1, wherein island end side surfaces on both sides of the island end are inclined surfaces so that a dimension in a width direction of the island end gradually decreases toward the end wall in a plan view.

8. A connector assembly comprising: the connector according to claim 1; and the counterpart connector which mates with the connector.

9. A connector comprising: a connector body, a terminal mounted on the connector body, and a reinforcing bracket mounted on the connector body; wherein:

the connector body includes a recess which is configured to mate with a counterpart connector body of a counterpart connector, a middle island inside the recess which is configured to mate with a recessed groove of the counterpart connector body, and a mating guide part which is formed on both ends in a longitudinal direction and on which a mating recess is formed into which a counterpart mating guide part formed on both ends in a longitudinal direction of the counterpart connector body is configured to be inserted;

the reinforcing bracket includes a main body part disposed on an end wall of the mating guide part, and a central guide part which is connected to the main body part, which has a tip which engages with an island end of the middle island, and which extends in a longitudinal direction of the connector body along an inside of the mating recess; and the central guide part includes an end wall inner cover part connected to the main body part, an island end cover part which is connected to the tip and covers at least a portion of the island end, and a bottom part which is connected to a lower end of the end wall inner cover part via a first curved part and is connected to a lower end of the island end cover part via a second curved part;

wherein a lower surface of the first curved part is positioned above a lower surface of the second curved part, and wherein the reinforcing bracket further includes a connecting arm part which is connected to both left and right ends of the main body part and extends in the longitudinal direction of the connector body, and a contact arm part which is connected to the connecting arm part and extends downward within the mating recess; and the contact arm part includes a contact part which is configured to make contact with a counterpart reinforcing bracket attached to the counterpart mating guide part inserted into the mating recess.

10. The connector according to claim 9, wherein a bottom plate which defines a bottom face of the mating recess has a bottom opening formed so as to penetrate the bottom plate in a plate thickness direction; the bottom part is housed inside the bottom opening; and the second curved part is exposed to a lower surface of the connector body.

11. The connector according to claim 9, wherein the bottom part is wider than other portions of the central guide part.

12. The connector according to claim 9, wherein the end wall inner cover part includes an inclined part having a base end connected to the main body part and extending diagonally downward.

13. The connector according to claim 12, wherein the inclined part is configured such that when a counterpart reinforcing bracket attached to the counterpart mating guide part of the counterpart connector body comes into contact with the inclined part, the counterpart reinforcing bracket slides along the inclined part, and the counterpart mating guide part is guided into the mating recess.

14. The connector according to claim 9, wherein island end side surfaces on both sides of the island end are inclined surfaces so that a dimension in a width direction of the island end gradually decreases toward the end wall in a plan view.

15. A connector assembly comprising: the connector according to claim 9; and the counterpart connector which mates with the connector.

* * * * *